US008703673B2

(12) United States Patent
Skinner

(10) Patent No.: US 8,703,673 B2
(45) **Date of Patent: *Apr. 22, 2014**

(54) METHOD OF IMPROVING THE COMPATIBILITY OF AN OVERBASED DETERGENT WITH OTHER ADDITIVES IN A LUBRICATING OIL COMPOSITION

(75) Inventor: Philip Skinner, Didcot (GB)

(73) Assignee: Infineum International Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/596,879

(22) PCT Filed: Apr. 10, 2008

(86) PCT No.: PCT/EP2008/002839

§ 371 (c)(1),
(2), (4) Date: Nov. 23, 2009

(87) PCT Pub. No.: WO2008/128657

PCT Pub. Date: Oct. 30, 2008

(65) Prior Publication Data

US 2010/0069273 A1 Mar. 18, 2010

(30) Foreign Application Priority Data

Apr. 24, 2007 (EP) ..... 07106870

(51) Int. Cl.
*C10M 159/24* (2006.01)
*C10M 159/22* (2006.01)
*C10M 129/76* (2006.01)

(52) U.S. Cl.
USPC ..... 508/391; 508/278; 508/501; 508/496; 508/460; 508/561

(58) Field of Classification Search
USPC ..... 508/278, 110, 501, 496, 561, 460, 391
See application file for complete search history.

(56) References Cited

U.S. PATENT DOCUMENTS

| | | | | |
|---|---|---|---|---|
| 4,059,536 | A * | 11/1977 | Lallement et al. | 508/291 |
| 4,192,758 | A * | 3/1980 | Dickey et al. | 508/397 |
| 4,614,602 | A | 9/1986 | Valcho et al. | |
| 4,865,754 | A | 9/1989 | Chang | |
| 2002/0183212 | A1 * | 12/2002 | Hammond et al. | 508/460 |
| 2006/0142626 | A1 * | 6/2006 | Campbell et al. | 585/24 |

FOREIGN PATENT DOCUMENTS

| | | | |
|---|---|---|---|
| EP | 0041851 | A | 12/1981 |
| EP | 1710294 | A | 10/2006 |

* cited by examiner

*Primary Examiner* — Vishal Vasisth

(57) ABSTRACT

A method of improving the compatibility of an overbased detergent with other additives in a lubricating oil composition. The method includes the step of the using a detergent have a degree of carbonation of greater than 85%.

11 Claims, No Drawings

METHOD OF IMPROVING THE COMPATIBILITY OF AN OVERBASED DETERGENT WITH OTHER ADDITIVES IN A LUBRICATING OIL COMPOSITION

This application is a 371 of PCT/EP08/02839, filed Apr. 10, 2008.

FIELD OF THE INVENTION

The present invention relates to a method of improving the compatibility of an overbased detergent with other additives in a lubricating oil composition, such as friction modifiers, other overbased detergents, dispersants, anti-oxidants, metal rust inhibitors, viscosity index improvers, corrosion inhibitors, oxidation inhibitors and anti-wear agents. In particular, the invention relates to a method of improving the compatibility of an overbased detergent with friction modifiers present in lubricating oil compositions.

BACKGROUND OF THE INVENTION

Currently there is a drive in terms of fuel economy for gasoline and diesel engines which has resulted in increased levels of organic friction modifiers being used in lubricating oil compositions, unfortunately, there are compatibility issues between the friction modifiers and overbased detergents, such as overbased calcium sulphonates. The present invention is therefore concerned with improving the compatibility between friction modifiers and overbased detergents in lubricating oil compositions.

SUMMARY OF THE INVENTION

In accordance with the present invention, there is provided a method of improving the compatibility of an overbased detergent with a further additive in a lubricating oil composition; the method including the step of using a detergent having a degree of carbonation of greater than 85%, wherein the degree of carbonation is the percentage of carbonate present in the overbased metal detergent expressed as a mole percentage relative to the total excess base in the detergent.

The overbased detergent preferably has a degree of carbonation of at least 86%, more preferably at least 87%, even more preferably at least 90%, even more preferably at least 91% and most preferably at least 92%. The degree of carbonation is preferably at most 100%, and more preferably at most 99%.

The further additive is preferably selected from friction modifiers, anti-oxidants, metal rust inhibitors, viscosity index improvers, corrosion inhibitors, oxidation inhibitors and anti-wear agents.

The further additive is preferably a friction modifier. The friction modifier is preferably selected from: glycerol monoesters; esters of long chain polycarboxylic acids with diols; oxazoline compounds; alkoxylated alkyl-substituted mono-amines, diamines and alkyl ether amines; and molybdenum compounds.

The overbased detergent is preferably an overbased phenate, salicylate or sulphonate. Most preferably, the overbased detergent includes at least two surfactants selected from phenol, salicylic acid and sulphonic acid. The overbased detergent is preferably an overbased calcium detergent.

The invention further provides a lubricating oil composition of enhanced stability comprising an oil of lubricating viscosity in either a concentrate-forming amount or in a major amount, and (A) a friction modifier additive, (B) an overbased detergent having a degree of carbonation of greater than 85%, and (C) optionally, one or more of an ashless dispersant, a metal dihydrocarbyl dithophosphate, and an antioxidant.

DETAILED DESCRIPTION OF THE INVENTION

Overbased Detergents

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps", that is metal salts of acidic organic compounds, sometimes referred to as surfactants.

Detergents generally comprise a polar head with a long hydrophobic tail, the polar head comprising a metal salt of an acidic organic compound. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

Surfactants that may be used include phenates, salicylates, sulphonates, sulphurized phenates, thiophosphonates, and naphthenates and other oil-soluble carboxylates. The metal may be an alkali or alkaline earth metal, e.g., sodium, potassium, lithium, calcium, and magnesium. Calcium is preferred.

Surfactants for the surfactant system of the overbased metal compounds preferably contain at least one hydrocarbyl group, for example, as a substituent on an aromatic ring.

Phenate surfactants may be non-sulphurized or sulphurized. Phenate include those containing more than one hydroxyl group (for example, from alkyl catechols) or fused aromatic rings (for example, alkyl naphthols) and those which have been modified by chemical reaction, for example, alkylene-bridged and Mannich base-condensed and saligenin-type (produced by the reaction of a phenol and an aldehyde under basic conditions).

Preferred phenols on which the phenate surfactants are based may be derived from the formula I below:

I

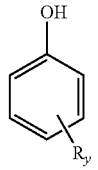

where R represents a hydrocarbyl group and y represents 1 to 4. Where y is greater than 1, the hydrocarbyl groups may be the same or different.

The phenols are frequently used in sulphurized form. Sulphurized hydrocarbyl phenols may typically be represented by the formula II below:

II

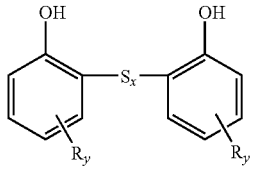

where x is generally from 1 to 4. In some cases, more than two phenol molecules may be linked by $S_x$ bridges.

In the above formulae, hydrocarbyl groups represented by R are advantageously alkyl groups, which advantageously contain 5 to 100, preferably 5 to 40, especially 9 to 15, carbon atoms, the average number of carbon atoms in all of the R groups being at least about 9 in order to ensure adequate solubility in oil. Preferred alkyl groups are dodecyl(tetrapropylene) groups.

In the following discussion, hydrocarbyl-substituted phenols will for convenience be referred to as alkyl phenols.

A sulphurizing agent for use in preparing a sulphurized phenol or phenate may be any compound or element which introduces —$(S)_x$— bridging groups between the alkyl phenol monomer groups, wherein x is generally from 1 to about 4. Thus, the reaction may be conducted with elemental sulphur or a halide thereof, for example, sulphur dichloride or, more preferably, sulphur monochloride. If elemental sulphur is used, the sulphurization reaction may be effected by heating the alkyl phenol compound at from 50 to 250, preferably at least 100, ° C. The use of elemental sulphur will typically yield a mixture of bridging groups —$(S)_X$— as described above. If a sulphur halide is used, the sulphurization reaction may be effected by treating the alkyl phenol at from −10 to 120, preferably at least 60, ° C. The reaction may be conducted in the presence of a suitable diluent. The diluent advantageously comprises a substantially inert organic diluent, for example mineral oil or an alkane. In any event, the reaction is conducted for a period of time sufficient to effect substantial reaction. It is generally preferred to employ from 0.1 to 5 moles of the alkyl phenol material per equivalent of sulphurizing agent.

Where elemental sulphur is used as the sulphurizing agent, it may be desirable to use a basic catalyst, for example, sodium hydroxide or an organic amine, preferably a heterocyclic amine (e.g., morpholine).

Details of sulphurization processes are well known to those skilled in the art.

Regardless of the manner in which they are prepared, sulphurized alkyl phenols generally comprise diluent and unreacted alkyl phenols and generally contain from 2 to 20, preferably 4 to 14, most preferably 6 to 12, mass % of sulphur, based on the mass of the sulphurized alkyl phenol.

As indicated above, the term "phenol" as used herein includes phenols which have been modified by chemical reaction with, for example, an aldehyde, and Mannich base-condensed phenols.

Aldehydes with which phenols may be modified include, for example, formaldehyde, propionaldehyde and butyraldehyde. The preferred aldehyde is formaldehyde. Aldehyde-modified phenols suitable for use are described in, for example, U.S. Pat. No. 5,259,967.

Mannich base-condensed phenols are prepared by the reaction of a phenol, an aldehyde and an amine. Examples of suitable Mannich base-condensed phenols are described in GB-A-2 121 432.

In general, the phenols may include substituents other than those mentioned above provided that such substituents do not detract significantly from the surfactant properties of the phenols. Examples of such substituents are methoxy groups and halogen atoms.

Salicylic acids may be non-sulphurized or sulphurized, and may be chemically modified and/or contain additional substituents, for example, as discussed above for phenols. Processes similar to those described above may also be used for sulphurizing a hydrocarbyl-substituted salicylic acid, and are well known to those skilled in the art. Salicylic acids are typically prepared by the carboxylation, by the Kolbe-Schmitt process, of phenoxides, and in that case, will generally be obtained (normally in a diluent) in admixture with uncarboxylated phenol.

Preferred substituents in oil-soluble salicylic acids from which overbased detergents may be derived are the substituents represented by R in the above discussion of phenols. In alkyl-substituted salicylic acids, the alkyl groups advantageously contain 5 to 100, preferably 9 to 30, especially 14 to 20, carbon atoms.

Sulphonic acids are typically obtained by sulphonation of hydrocarbyl-substituted, especially alkyl-substituted, aromatic hydrocarbons, for example, those obtained from the fractionation of petroleum by distillation and/or extraction, or by the alkylation of aromatic hydrocarbons. Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from 3 to more than 100 carbon atoms, such as, for example, haloparaffins, olefins that may be obtained by dehydrogenation of paraffins, and polyolefins, for example, polymers of ethylene, propylene, and/or butene. The alkylaryl sulphonic acids usually contain from 7 to 100 or more carbon atoms. They preferably contain from 16 to 80, or 12 to 40, carbon atoms per alkyl-substituted aromatic moiety, depending on the source from which they are obtained.

When neutralizing these alkylaryl sulphonic acids to provide sulphonates, hydrocarbon solvents and/or diluent oils may also be included in the reaction mixture, as well as promoters and viscosity control agents.

Another type of sulphonic acid comprises alkyl phenol sulphonic acids. Such sulphonic acids can be sulphurized. Whether sulphurized or non-sulphurized these sulphonic acids are believed to have surfactant properties comparable to those of sulphonic acids, rather than surfactant properties comparable to those of phenols.

Sulphonic acids also include alkyl sulphonic acids, such as alkenyl sulphonic acids. In such compounds the alkyl group suitably contains 9 to 100, advantageously 12 to 80 especially 16 to 60, carbon atoms.

Carboxylic acids include mono- and dicarboxylic acids. Preferred monocarboxylic acids are those containing 1 to 30, especially 8 to 24, carbon atoms. Examples of monocarboxylic acids are iso-octanoic acid, stearic acid, oleic acid, palmitic acid and behenic acid. Iso-octanoic acid may, if desired, be used in the form of the mixture of $C_8$ acid isomers sold by Exxon Chemicals under the trade name "Cekanoic". Other suitable acids are those with tertiary substitution at the α-carbon atom and dicarboxylic acids with more than 2 carbon atoms separating the carboxylic groups. Further, dicarboxylic acids with more than 35, for example, 36 to 100, carbon atoms are also suitable. Unsaturated carboxylic acids can be sulphurized. Although salicylic acids contain a carboxylic group, for the purposes of the present invention they are considered to be a separate group of surfactants, and are not considered to be carboxylic acid surfactants. (Nor, although they contain a hydroxyl group, are they considered to be phenol surfactants.)

Examples of other surfactants which may be used in accordance with the invention include the following compounds, and derivatives thereof: naphthenic acids, especially naphthenic acids containing one or more alkyl groups, dialkylphosphonic acids, dialkylthiophosphonic acids, and dialkyldithiophosphoric acids, high molecular weight (preferably ethoxylated) alcohols, dithiocarbamic acids, thiophosphines, and dispersants. Surfactants of these types are well known to those skilled in the art. Surfactants of the hydrocarbyl-substituted carboxylalkylene-linked phenol type, or dihydrocarbyl esters of alkylene dicarboxylic acids, the alkylene group being substituted with a hydroxy group and an additional carboxylic acid group, or alkylene-linked polyaromatic molecules, the aromatic moieties whereof comprise at least one hydrocarbyl-substituted phenol and at least one carboxy phenol, may also be suitable for use in the present invention; such surfactants are described in EP-A-708 171.

Further examples of detergents are sulphurized alkaline earth metal hydrocarbyl phenates that have been modified by carboxylic acids such as stearic acid, for examples as described in EP-A-271 262 (LZ-Adibis); and phenolates as described in EP-A-750 659 (Chevron).

The detergent may also contain at least two surfactant groups, such as groups selected from: phenol, sulphonic acid, carboxylic acid, salicylic acid and naphthenic acid, that may be obtained by manufacture of a hybrid material in which two or more different surfactant groups are incorporated during the overbasing process.

Examples of hybrid materials are an overbased calcium salt of surfactants phenol and sulphonic acid; an overbased calcium salt of surfactants phenol and carboxylic acid; an overbased calcium salt of surfactants phenol, sulphonic acid and salicylic acid; and an overbased calcium salt of surfactants phenol and salicylic acid.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Preferably, the TBN of the hybrid detergent is at least 300, such as at least 350, more preferably at least 400, most preferably in the range of from 400 to 600, such as up to 500.

In the instance where at least two overbased metal compounds are present, any suitable proportions by mass may be used, preferably the mass to mass proportion of any one overbased metal compound to any other metal overbased compound is in the range of from 5:95 to 95:5; such as from 90:10 to 10:90; more preferably from 20:80 to 80:20; especially from 70:30 to 30:70; advantageously from 60:40 to 40:60.

Particular examples of hybrid materials include, for example, those described in WO-A-97/46643; WO-A-97/46644; WO-A-97/46645; WO-A-97/46646; and WO-A-97/46647.

The detergent may also be, for example, a sulphurized and overbased mixture of a calcium alkyl phenate and a calcium alkyl salicylate: an example is described in EP-A-750,659, namely:

a detergent-dispersant additive for lubricating oil of the sulphurised and superalkalinised, alkaline earth alkylsalicylate-alkylphenate type, characterised in that:

a) the alkyl substituents of the said alkylsalicylate-alkylphenate are in a proportion of at least 35 wt. % and at most 85 wt. % of linear alkyl in which the number of carbon atoms is between 12 and 40, preferably between 18 and 30 carbon atoms, with a maximum of 65 wt. % of branched alkyl in which the number of carbon atoms is between 9 and 24 and preferably 12 carbon atoms;

b) the proportion of alkylsalicylate in the alkylsalicylate-alkylphenate mixture is at least 22 mole % and preferably at least 25 mole %, and c) the molar proportion of alkaline earth base with respect to alkylsalicylate-alkylphenate as a whole is between 1.0 and 3.5.

The term "overbased" is generally used to describe metal detergents in which the ratio of the number of equivalents of the metal moiety to the number of equivalents of the acid moiety is greater than one. Typically, this ratio is greater than 2 and may be as high as 20 or greater. The term 'low-based' is used to describe metal detergents in which the equivalent ratio of metal moiety to acid moiety is greater than 1, and up to 2. The term 'normal' or 'neutral' is used to describe metal detergents in which the equivalent ratio of metal moiety to acid moiety is one. For this reason, overbased metal detergents have a greater capability for neutralising acidic matter than do the corresponding neutral metal detergents, though not necessarily an increased detergency power.

Carbonated overbased metal detergents typically comprise amorphous nanoparticles. Additionally, there are disclosures of nanoparticulate materials comprising carbonate in the crystalline calcite and vaterite forms.

Overbased calcium sulphonates can be prepared by any of the techniques employed in the art. They are generally produced by carbonation of a stoichiometric excess (over that required to react with the sulphonic acid) of calcium oxide or hydroxide dispersed in a reaction medium comprising: an oil solution of a sulphonic acid, a volatile hydrocarbon solvent and certain reaction promoters such as water and lower alcohols, especially methanol. Neutralisation of the sulphonic acid typically occurs in situ and precedes carbonation. However, if desired, a calcium compound may be pre-reacted with the sulphonic acid in a separate stage.

The basicity of the detergents is preferably expressed as a total base number (TBN). A total base number is the amount of acid needed to neutralize all of the basicity of the overbased material. The amount of acid is expressed as the equivalent amount of potassium hydroxide. The TBN may be determined according to ASTM D2896. The detergent may have a low TBN (i.e. a TBN of less than 50), a medium TBN (i.e. a TBN of 50 to 150) or a high TBN (i.e. a TBN of greater than 150, such as 150-500). Preferred materials according to the invention have a TBN of at least 250, preferably up to 400 or more.

Carbonation may be effected in one or more stages, over a range of temperatures up to the reflux temperature of the alcohol promoters. Addition temperatures may be similar, or different, or may vary during each addition stage. Phases in which temperatures are raised, and optionally then reduced may precede further carbonation steps.

Lime (calcium hydroxide) may be charged in one or more stages. The charges may be equal or may differ, as may the carbon dioxide charges which follow them. When adding a further calcium hydroxide charge, the carbon dioxide treatment of the previous stage need not be complete. As carbonation proceeds, dissolved hydroxide is converted into colloidal carbonate particles dispersed in the mixture of volatile hydrocarbon solvent and non-volatile hydrocarbon oil. The sulphonic acid may be charged before or after the first lime charge. Instead of a sulphonic acid, an alkaline earth metal sulphonate can be used; for example calcium sulphonate.

The alkanol is preferably methanol although other alcohols such as ethanol can be used.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The ratio of alkanol to hydrocarbon solvents is important. If there is too much alkanol the resulting product will be greasy, whereas with too much hydrocarbon solvent there will be excessive viscosity of the reaction mixture whilst carbon dioxide and any calcium hydroxide are added.

Additional reaction promoters may be used and these may be ammonium carboxylates such as those derived from $C_1$ to $C_3$ saturated monocarboxylic acids, e.g. formic acid, acetic acid, or propionic acid.

The water content of the initial reaction mixture is important to obtain the desired product. It is also important during carbonation; especially for avoidance of the phenomenon known as "over" carbonation.

Oil may be added to the reaction mixture; if so, suitable oils include hydrocarbon oils, particularly those of mineral origin. Oils which have viscosities of 15 to 30 cSt at 38° C. are very suitable.

After the final treatment with carbon dioxide, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after solvent removal.

The products are generally used as an oil solution. If there is insufficient oil present in the reaction mixture to retain an oil solution after removal of the volatiles, further oil should be added. This may occur before, or at an intermediate point, or after solvent removal. The desired overbased detergent additive may have a TBN of 250 or more, typically 400, following these measures.

Overbased calcium salicylates can be prepared by any of the techniques employed in the art. Typically, they are prepared using the same means as for calcium sulphonates.

Overbased calcium phenates can be prepared by any of the techniques employed in the art. They can be prepared using the same means as for calcium sulphonates. However, more typically overbased calcium sulphurised phenates are prepared via higher temperature processes in which sulphurisation follows neutralisation, prior to carbonation. A neutralisation promoter is used to facilitate calcium phenoxide formation; thereby activating the substrate sufficiently to permit the use of inexpensive elemental sulphur. Ethylene glycol is a typical neutralisation promoter. Reactions are typically run in higher alkanol solvents. Co-surfactants are more frequently used to assure adequate product stability; these are typically sulphonates or aliphatic carboxylates. Carbonation may occur at any temperature up to the reflux temperature of the higher alcohol/ethylene glycol mixture. At such elevated temperatures, water is removed substantially as it forms and so anhydrous conditions pertain during carbonation. This tends to reduce or eliminate the possibility of overcarbonation. Solvent removal and product clarification follows the same principles as described for calcium sulphonates. Additional materials may form an integral part of the overbased metal detergent. These may, for example, include long chain amides. Suitable amides are oleamide, stearamide and erucamide. These may also include long chain aliphatic mono- or di-carboxylic acids. Suitable carboxylic acids included stearic and oleic acids, and polyisobutylene (PIB) succinic acids.

Degree of Carbonation ('DOC')

Under certain conditions (see below), it is possible to achieve a good approximation of desired degree of carbonation ('DOC') levels by theoretical calculation. This is the case for the Examples of this invention. These conditions ensure substantially complete absorption of the carbon dioxide. Suitable conditions include:

- low reactant temperatures (e.g. room temperature);
- slow addition rates (e.g. 0.5 g $CO_2$ per minute per kilogram of product—or about 300 ml per minute per kilogram of product at STP); and
- careful consideration of reactor engineering, to ensure that carbon dioxide does not vent to atmosphere before it has had the opportunity to react with lime.

When these conditions are satisfied, the required amount of carbon dioxide can be charged by weight to the reactor. When the required quantity has entered the reactor, carbon dioxide addition is stopped. At lower target degree of carbonation ('DOC') levels, measured values tend to exceed expectation, perhaps reflecting the slowness of calcium hydroxide incorporation into the colloidal particles. Higher residual sediment levels and lower TBN values are observed. At higher target degree of carbonation ('DOC') levels, the opposite is observed, with measured values tending to fall below expectation. The reason for this is not certain; it could be that some minor losses of carbon dioxide occur, as the reactant mixture thickens during carbonation. For the Examples of this invention, carbon dioxide losses ranged between 1-4% relative to expectation. It may be that further attention to reactor design would eliminate these losses. Achieving the desired degree of carbonation ('DOC') level at higher carbonation temperatures (e.g., under methanol reflux), or with faster carbon dioxide addition rates, requires practical experience to determine the necessary excess. In these circumstances, analytical determinations are essential to determine degree of carbonation ('DOC') levels.

Degree of Carbonation ('DOC') Determination

Metal Carbonate Content By Carbon Dioxide Liberation

Alkali and alkaline earth metal carbonates quantitatively liberate carbon dioxide upon treatment with many strong acids. Absorption of liberated carbon dioxide by a suitable reagent, followed by titration, allows calculation of the detergent's metal carbonate content. One suitable approach boils a detergent sample (0.2-5.0 g) with excess (e.g. 2 molar) hydrochloric acid. The liberated carbon dioxide is absorbed in a mixture of monoethanolamine in dimethylformamide (1 to 40 parts by volume) and simultaneously titrated with standard (e.g. 0.1 molar) alcoholic tetrabutylammonium hydroxide solution, using thymol blue (3 to 1 parts monoethanolamine, grams per liter) as the indicator. Optionally, interference from hydrogen sulfide is prevented by absorption in a tube containing a suitable reagent, e.g., silver orthovanadate. Care should be taken to exclude atmospheric carbon dioxide from the titrant, by use of guard tubes containing commercial carbon dioxide absorbent (e.g. 20 mesh). To ensure the absorbent mixture is free of carbon dioxide, it is neutralised prior to each reaction/titration using the standard alcoholic tetrabutylammonium hydroxide solution, until the persistent blue colour of the (thymol blue) indicator appears. Good circulation of the absorbent mixture is advisable to ensure complete absorption of the liberated carbon dioxide. A nitrogen flow aids transfer of liberated carbon dioxide from reaction vessel into the absorbent mixture. The titration itself is continued until the persistent blue colour of the indicator appears. A blank determination is advisable.

Calculation:

$$\text{Liberated Carbon Dioxide} = \frac{[(\text{TBAH vol.(ml)}) \times (\text{TBAH } conc^{n} \cdot (\text{moles/l}) \times 10^{3})]}{\text{mass of detergent sample (g)}}$$

(TBAH = tetrabutylammoniumhydroxide)

Then:

Metal as carbonate(mmoles/kg)=Liberated carbon dioxide(mmoles/kg)

A similar procedure is described in 'Rapid Method of Determining Carbonates in Sulphonate Additives' by A. F. Lyashenko, V. I. Borisova and A. U. Mazurenko in Trudy-Vsesoyuznyi Nauchno-Issledovatel'skii Institut po Pererabotke Nefti (1976), 14, 217-20.

Metal Hydroxide Content By Strong Base Number

One analytical method to determine strong (or "direct") base number involves titration to phenolphthalein neutral point of a sample dissolved in isopropanol/toluene; with added water/sugar solution (e.g. as described in U.S. Pat. No. 5,259,966, and also cited thereafter in US 20060183650A1, U.S. Pat. No. 6,310,009, U.S. Pat. No. 6,268,318 & U.S. Pat. No. 6,015,778). Strong bases include calcium oxide, calcium hydroxide and also various calcium alkoxides. In processing, calcium hydroxide reacts with sulphonic acid and phenols to form calcium sulphonate and calcium phenate respectively. Neither the calcium sulphonate nor the calcium phenate give a strong base number measurement, i.e., these salts do not titrate to phenolphthalein indicator. Calcium hydroxide also reacts with carbon dioxide to create colloidal calcium carbonate. This also does not give a strong base number measurement. The strong base number in the products of this invention relates to unconsumed calcium hydroxide.

$$\text{Metal as Strong Base (mmoles/kg)} = \frac{SBN \times 10^{2}}{\text{Metal Valency} \times \text{Mol. Wt. KOH}}$$

Degree of Carbonation ('DOC') Calculation

Using the above determinations, DOC can be calculated as follows:

$$DOC(\text{mole \%}) = \frac{(\text{Metal as Carbonate})}{[(\text{Metal as Carbonate}) + (\text{Metal as Strong Base})]} \times 10^{2}$$

Friction Modifiers

The friction modifiers include glyceryl monoesters of higher fatty acids, for example, glyceryl mono-oleate; esters of long chain polycarboxylic acids with diols, for example, the butane dial ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. As an example of such oil-soluble organo-molybdenum compounds, there may be mentioned the dithiocarbamates, dithiophosphates, dithiophosphinates, xanthates, thioxanthates, sulphides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

The molybdenum compounds may be of the formula $Mo(ROCS_2)_4$ and $Mo(RSCS_2)_4$ wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1

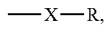

2

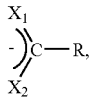

3

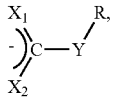

4

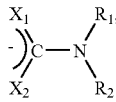

and

5

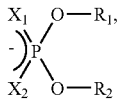

and mixtures thereof, wherein X, $X_1$, $X_2$, and Y are independently selected from the group of oxygen and sulphur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulphoxy, etc.).

3. Hetero substituents, that is, substituents which, while predominantly hydrocarbon in character within the context of this invention, contain atoms other is than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between 1 to 100, preferably from 1 to 30, and more preferably between 4 to 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds requires selection of ligands having the appropriate charge to balance the core's charge.

Compounds having the formula $Mo_3S_kL_nQ_z$ have cationic cores surrounded by anionic ligands and are represented by structures such as

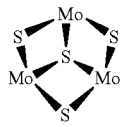

and

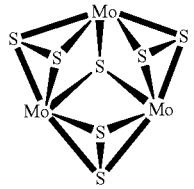

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. This includes the case of a multidentate ligand having multiple connections to a single core. It is believed that oxygen and/or selenium may be substituted for sulphur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulphide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulphide, dialkyldithiocarbamate, or dialkyldithiophosphate, and a sulphur abstracting agent such cyanide ions, sulphite ions, or substituted phosphines. Alternatively, a trinuclear molybdenum-sulphur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. At least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulphide and mixtures thereof. Most preferably, the molybdenum compound is present as molybdenum dithiocarbamate. The molybdenum compound may also be a trinuclear molybdenum compound.

Dihydrocarbyl Dithiophosphate Metal Salts

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oils in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

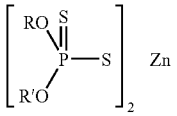

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The present invention may be particularly useful when used with lubricant compositions containing phosphorus levels of from 0.02 to 0.12 wt. %, preferably from 0.03 to 0.10 wt. %. More preferably, the phosphorous level of the lubricating oil composition will be less than 0.08 wt. %, such as from 0.05 to 0.08 wt. %.

Ashless Dispersants

Ashless dispersants maintain in suspension oil insolubles resulting from oxidation of the oil during wear or combustion. They are particularly advantageous for preventing the precipitation of sludge and the formation of varnish, particularly in gasoline engines. Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is a non-conjugated diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene). Preferred are polyisobutenyl (Mn 400-2500, preferably 950-2200) succinimide dispersants. Preferably, heavy duty diesel (HDD) engine lubricating oil compositions of the present invention contain an amount of a nitrogen-containing dispersant introducing from 0.08 to 0.25 mass %, preferably from 0.09 to 0.18 mass %, more preferably from 0.10 to 0.15 mass %, of nitrogen into the composition.

Oxidation Inhibitors

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, alkylphenol sulphides, oil soluble phenates and sulphurized phenates, phosphosulphurized or sulphurized hydrocarbons or esters, phosphorous esters, metal thiocarbamates, oil soluble copper compounds as described in U.S. Pat. No. 4,867,890, and molybdenum-containing compounds.

Phosphorus-free supplemental oxidation inhibitors, other than the previously described hindered phenol antioxidants, suitable for use in the present invention include alkaline earth metal salts of alkylphenolthioesters having preferably $C_5$ to $C_{12}$ alkyl side chains, calcium nonylphenol sulfide, ashless oil soluble phenates and sulfurized phenates and phosphosulfurized or sulfurized hydrocarbons.

Aromatic amines having at least two aromatic groups attached directly to the nitrogen constitute another class of compounds that is frequently used for antioxidancy. They are preferably used in only small amounts, i.e., up to 0.4 wt. %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulphur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil-soluble aromatic amines having at least two aromatic groups attached directly to one amine nitrogen should preferably not exceed 0.4 wt. % active ingredient.

Viscosity Modifiers

Viscosity modifiers (VM) function to impart high and low temperature operability to a lubricating oil. The VM used may have that sole function, or may be multifunctional. Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene. Multifunctional viscosity modifiers that further function as dispersants are also known.

A viscosity index improver dispersant functions both as a viscosity index improver and as a dispersant. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

Pour Point Depressants

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates.

Rust Inhibitors

Rust inhibitors selected from the group consisting of non-ionic polyoxyalkylene polyols and esters thereof, polyoxyalkylene phenols, and anionic alkyl sulfonic acids may be used.

Corrosion Inhibitors

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 mass % active ingredient.

Demulsifying Component

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Foam Control

Foam control can be provided by many compounds including an antifoamant of the polysiloxane type, for example, silicone oil or polydimethyl siloxane.

In the present invention it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

It is not unusual to add an additive to a lubricating oil, or additive concentrate, in a diluent, such that only a portion of the added weight represents an active ingredient (A.I.). For example, dispersant may be added together with an equal weight of diluent in which case the "additive" is 50% A.I. dispersant. On the other hand, detergents are conventionally formed in diluent to provide a specified TBN and are oftentimes not referred to on an A.I. basis. As used herein, the term mass percent (mass %), when applied to a detergent refers to the total amount of detergent and diluent unless otherwise indicated, and when applied to all other additive refers to the weight of active ingredient unless otherwise indicated.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature. When lubricating compositions contain one or more of the above-mentioned additives, each additive is typically blended into the base oil in an amount that enables the additive to provide its desired function. Representative amounts of such additives, used in crankcase lubricants, are listed below. All the values listed are stated as mass percent active ingredient.

| ADDITIVE | MASS % (Broad) | MASS % (Preferred) |
|---|---|---|
| Ashless Dispersant | 0.1-20 | 1-8 |
| Metal Detergents | 0.1-6 | 0.2-4 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-1.5 |
| Pour Point Depressant | 0.01-5 | 0.01-1.5 |
| Antifoaming Agent | 0-5 | 0.001-0.15 |
| Supplemental Antiwear Agents | 0-0.5 | 0-0.2 |
| Friction Modifier | 0-5 | 0-1.5 |
| Viscosity Modifier | 0-6 | 0.01-4 |
| Basestock | Balance | Balance |

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

Crankcase Lubricating Oil Formulation

A crankcase lubricating oil formulation may employ from 2 to 25 mass %, preferably 4 to 20 mass %, and most preferably about 5 to 18 mass % of the concentrate or additive package with the remainder being base stock. Preferably the volatility of the final crankcase lubricating oil formulation, as measured by the Noack volatility test (ASTM D5880), is less than or equal to 15 mass %, preferably less than or equal to 13 mass %, more preferably less than or equal to 12 mass %, most preferably less than or equal to 10 mass %. Preferably, lubricating oil compositions of the present invention have a compositional TBN (using ASTM D4739) of less than 10.5, such as between 7.5 and 10.5, preferably less than or equal to 9.5, such as 8.0 to 9.5.

Lubricating Oils

The lubricating oils may range in viscosity from light distillate mineral oils to heavy lubricating oils such as gasoline engine oils, mineral lubricating oils and heavy duty diesel oils. Generally, the viscosity of the oil ranges from 2 $mm^2$/sec (centistokes) to 40 $mm^2$/sec, especially from 4 $mm^2$/sec to 20 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

The oil of lubricating viscosity may comprise a Group I, Group II, Group III, Group IV or Group V base stocks or base oil blends of the aforementioned base stocks. Preferably, the oil of lubricating viscosity is a Group III, Group IV or Group V base stock, or a mixture thereof provided that the volatility of the oil or oil blend, as measured by the NOACK test (ASTM D5880), is less than or equal to 13.5%, preferably less than or equal to 12%, more preferably less than or equal to 10%, most preferably less than or equal to 8%; and a viscosity index (VI) of at least 120, preferably at least 125, most preferably from 130 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

| Analytical Methods for Base Stock | |
|---|---|
| Property | Test Method |
| Saturates | ASTM D 2007 |
| Viscosity Index | ASTM D 2270 |
| Sulphur | ASTM D 2622<br>ASTM D 4294<br>ASTM D 4927<br>ASTM D 3120 |

EXAMPLES

The present invention is illustrated by but in no way limited to the following examples.

Preparation of Overbased Calcium Sulphonate-Phenate Detergents

Six overbased detergents were prepared using different charges of carbon dioxide to produce different degrees of carbonation (see Table 1). The overbased detergents were prepared using the following method:

835 g toluene, 417 g methanol, 23 g water, and 18 g of diluent oil (Group I 150N) were introduced into a reactor and mixed while maintaining the temperature at approximately 20° C. Calcium hydroxide ($Ca(OH)_2$) (127 g) was added, and the mixture was heated to 40° C., with stirring. To the slurry obtained in this way was added 65 g of a sulphurised phenol (78% a.i., 1384 mmoles/kg) and 192 g (82% a.i., 1242 mmoles/kg) of an alkyl benzene sulphonic acid, diluted in 150 g toluene. The temperature of the mixture was reduced to approximately 28° C., and maintained at this temperature while 50% of the carbon dioxide charge (see Table 1 for total charge in grams of carbon dioxide for each example) was injected into the mixture over a period of 2 hours. The temperature was then raised to 60° C. over 1 hour, before cooling back to a temperature of approximately 28° C. A further quantity of calcium hydroxide (111 g) was added and then the temperature was maintained at approximately 28° C. while the remaining 50% of the carbon dioxide charge (see Table 1 for the charge in grams of carbon dioxide for each example) was again injected into the mixture over a period of 2 hours. After this second carbonation step, the temperature was raised to 60° C. over 90 minutes. To complete the synthesis, the product was heated from 60 to 160° C. in four hours to remove the solvents and water. This solvent stripping process was performed in three stages:

under atmospheric pressure to 114° C. During this stage, when the temperature reached 75° C., a further charge of diluent oil (see Table 1 for the oil charge in grams for each example) was added;

under a pressure of 500 mbar between 114° C. and 125° C.; and then under a pressure of 250 mbar between 125° C. and 160° C.

The product was filtered at 150° C. to remove sediment.

The key properties of the overbased detergents are given in Table 2.

TABLE 1

| | Sulphonic Acid | | Sulphurised Phenol | | Calcium Hydroxide | | Carbon Dioxide | | |
|---|---|---|---|---|---|---|---|---|---|
| Ex | Charge, g | Charge, mass % on product | Charge, g | Charge, mass % on product | Charge, g | Charge, mass % on product | Charge, g | Charge, mass % on product | Oil Charge Charge, g |
| 1 | 192 | 26.4 | 65 | 7.2 | 238 | 26.4 | 77 | 97.6 | 348 |
| 2 | 192 | 26.4 | 65 | 7.2 | 238 | 26.4 | 80 | 100.6 | 345 |
| 3 | 192 | 26.4 | 65 | 7.2 | 238 | 26.4 | 86 | 109 | 339 |
| 4 | 192 | 26.4 | 65 | 7.2 | 238 | 26.4 | 89 | 112.8 | 337 |
| 5 | 192 | 26.4 | 65 | 7.2 | 238 | 26.4 | 94 | 119.2 | 333 |
| 6 | 192 | 26.4 | 65 | 7.2 | 238 | 26.4 | 95 | 120.4 | 333 |

TABLE 2

| | Degree of Carbonation ('DOC') | | | | Residual | TBN (ASTM D2896) | | | Kinematic Viscosity ASTM D445 | | |
|---|---|---|---|---|---|---|---|---|---|---|---|
| Ex | CO2, mass % | $CaCO_3$, mass % | $Ca(OH)_2$, mass % | DOC, mole % | Lime Vol % | Actual, mgKOH/g | Target, mgKOH/g | Delta, mgKOH/g | 100 C. | 40 C. | VI |
| 1 | 10.0 | 22.7 | 3.5 | 82.9 | 5.2 | 317 | 370 | −53 | | | |
| 2 | 11.3 | 25.7 | 3.4 | 84.8 | 4.4 | 349 | 370 | −21 | | | |
| 3 | 11.9 | 27.0 | 3.5 | 85.1 | 1.4 | 366 | 370 | −4 | 99 | 1573 | 144 |
| 4 | 12.4 | 28.2 | 3.1 | 87.0 | 0.6 | 373 | 370 | 3 | 100 | 1571 | 145 |
| 5 | 12.8 | 29.1 | 2.3 | 90.5 | 0.6 | 370 | 370 | 0 | 101 | 1581 | 146 |
| 6 | 13.2 | 30.0 | 1.6 | 93.3 | 0.8 | 370 | 370 | 0 | 96 | 1463 | 147 |

Evaluation of Compatibility With Friction Modifier

The detergents with varying DOC levels from Tables 1 and 2 were combined with conventional components to create GF-4 type PCMO additive concentrates, as shown in Table 3. The conventional components included two organic friction modifiers, with which conventional overbased calcium detergents can exhibit compatibility problems. One manifestation of this incompatibility is sediment formation, resulting from colloid destabilisation. The blending procedure and order were identical (preblending of dispersant and detergent at higher temperature, followed by mixing of detergent/dispersant preblend with other additives at lower temperature).

TABLE 3

| Component | Mass (%) |
|---|---|
| PIBSA-PAM dispersant (50% a.i.) | 37 |
| 370 TBN Detergent[1] from Examples 1-6 in Tables 1 and 2 | 15 |
| Diluent oil | 14.99 |
| ZDDP | 11 |
| nonyl alkylated diphenylamines | 8 |
| Ethanox 4716[2] | 7 |
| Molybdenum antiwear | 2 |
| GMO[3] | 3.5 |
| E-T-2[4] | 1.5 |
| antifoamant | 0.01 |
| total | 100 |

[1]Blended to constant TBN. Treat increased proportionately for detergents of TBN below 370.
[2]Trade name, a C8 hindered phenol antioxidant from Albemarle Corporation.
[3]Glycerol Mono Oleate.
[4]Ethoxylated tallow amine, ex Tomah products.

Each additive concentrate was then subjected to a storage stability test in which the concentrates were stored for a number of weeks at 60° C. with periodic measuring of the amount of sediment formed. An additive concentrate was deemed to have failed the stability test at the time the amount of sediment measured was greater than 0.05 vol. %, based on the total weight of the concentrate. Compatibility results are given in Table 4. Significant compatibility improvement occurs above 85% DOC, as determined from evolved carbon dioxide values. There is progressive improvement up to 93% DOC, at which point failure only occurs after 12 weeks storage.

TABLE 4

| | DOC ex % $CO_2$ | | | | | |
|---|---|---|---|---|---|---|
| | 82.9 | 84.8 | 85.1 | 87.0 | 90.5 | 93.3 |
| | Ex | | | | | |
| Week | 1 | 2 | 3 | 4 | 5 | 6 |
| 0 | 0.00 | 0.00 | 0.00 | 0.00 | 0.00 | 0.00 |
| 1 | 0.00 | 0.00 | 0.00 | 0.00 | 0.00 | 0.00 |
| 2 | 0.00 | 0.25 | 0.00 | 0.00 | 0.00 | 0.00 |
| 3 | 0.25 | 1.00 | 0.20 | 0.00 | 0.00 | 0.00 |
| 4 | 0.50 | 1.00 | 0.25 | 0.00 | 0.00 | 0.00 |
| 5 | 0.70 | 1.40 | 0.30 | 0.00 | 0.00 | 0.00 |
| 6 | 0.70 | 1.40 | 0.50 | trace | trace | trace |
| 7 | 0.70 | 1.40 | 0.70 | trace | trace | trace |
| 8 | 0.80 | 1.40 | 0.70 | 0.10 | trace | trace |
| 9 | 1.00 | 1.50 | 0.80 | 0.10 | 0.05 | 0.05 |
| 10 | 1.00 | 1.50 | 1.00 | 0.15 | 0.10 | 0.05 |
| 11 | 1.00 | 1.50 | 1.00 | 0.15 | 0.10 | 0.05 |
| 12 | | | 1.00 | 0.20 | 0.15 | 0.10 |

The invention claimed is:

1. A method of improving the compatibility of an overbased detergent with a further additive in a lubricating oil composition, the method including the step of using a detergent having a degree of carbonation of greater than 85%, wherein the degree of carbonation is the percentage of carbonate present in the overbased metal detergent expressed as a mole percentage relative to the total excess base in the detergent.

2. The method claimed in claim 1, wherein the degree of carbonation is at least 86%.

3. The method claimed in claim 2, wherein the degree of carbonation is at least 87%.

4. The method claimed in claim 3, wherein the degree of carbonation is at least 90%.

5. The method claimed in claim 4, wherein the degree of carbonation is at least 92%.

6. The method claimed in claim 1, wherein the further additive is selected from friction modifiers, dispersants, antioxidants, metal rust inhibitors, viscosity index improvers, corrosion inhibitors, oxidation inhibitors and anti-wear agents, preferably a friction modifier.

7. The method as claimed in claim 6, wherein the further additive is a friction modifier.

8. The method as claimed in claim 7, wherein the friction modifier is selected from: glycerol monoesters; esters of long chain polycarboxylic acids with diols; oxazoline compounds, alkoxylated alkyl-substituted mono-amines, diamines and alkyl ether amines; and molybdenum compounds.

9. The method as claimed in claim 1, wherein the overbased detergent is one or more overbased phenate, salicylate or sulphonate detergent, or a mixture thereof.

10. The method as claimed in claim 1, wherein the overbased detergent includes at least two surfactants selected from phenol, salicylic acid and sulphonic acid.

11. The method as claimed in claim 1, wherein the overbased detergent is an overbased calcium detergent.

* * * * *